United States Patent [19]

Siskin et al.

[11] Patent Number: 4,587,004

[45] **Date of Patent: * May 6, 1986**

[54] PROCESS FOR BENEFICIATING OIL-SHALE

[75] Inventors: Michael Siskin, Livingston; Glen Brons, Phillipsburg, both of N.J.

[73] Assignee: Exxon Research and Engineering Co., Florham Park, N.J.

[ * ] Notice: The portion of the term of this patent subsequent to Jan. 1, 2002 has been disclaimed.

[21] Appl. No.: 686,608

[22] Filed: Dec. 27, 1984

Related U.S. Application Data

[63] Continuation-in-part of Ser. No. 600,431, Apr. 16, 1984, Pat. No. 4,491,513.

[51] Int. Cl.[4] ..... C10G 1/04

[52] U.S. Cl. ..... 208/429; 423/114; 423/119; 423/131; 423/157; 423/658.5; 208/435

[58] Field of Search ..... 208/8 LE, 11 LE; 423/114, 119, 131, 130, 157, 658.5

[56] References Cited

U.S. PATENT DOCUMENTS

| | | | |
|---|---|---|---|
| 3,503,705 | 3/1970 | Tackett | 423/119 |
| 3,516,787 | 6/1970 | Van Nordstrand | 423/119 |
| 3,642,433 | 2/1972 | Dyni | 423/119 |
| 3,721,730 | 3/1973 | Haas | 423/119 |
| 3,821,353 | 6/1974 | Weichman | 423/119 |
| 3,859,413 | 1/1975 | Haas | 423/119 |
| 3,962,403 | 6/1976 | Wyslouzil | 423/206 R |
| 4,176,042 | 11/1979 | Fahlström | 423/658.5 |
| 4,250,016 | 2/1981 | Estes et al. | 208/11 LE |
| 4,342,729 | 8/1972 | Garcial et al. | 423/131 |
| 4,408,999 | 10/1983 | Nadkarni et al. | 208/11 LE |
| 4,490,238 | 12/1984 | Siskin | 208/11 LE |
| 4,491,513 | 1/1985 | Siskin et al. | 208/11 LE |
| 4,491,514 | 1/1985 | Siskin et al. | 208/11 LE |

*Primary Examiner*—Andrew H. Metz
*Assistant Examiner*—A. Pal
*Attorney, Agent, or Firm*—Henry E. Naylor

[57] ABSTRACT

Disclosed is a process for beneficiating oil-shale wherein the oil-shale is treated in a first stage with an aqueous ammonium salt solution and in a second stage and optionally a third stage in the presence of a solution containing ammonium ions/ammonia, or both. The pH of the first stage is from about 5 to 9, and the pH of the second and third stages are from about 0.5 to 5 or about 9 to 12 with the proviso that the pH of the second and third stage is not in the same range.

23 Claims, No Drawings

PROCESS FOR BENEFICIATING OIL-SHALE

CROSS REFERENCE TO RELATED APPLICATIONS

This application is a Continuation-in-Part application of copending U.S. Ser. No. 600,431, filed Apr. 16, 1984 and now U.S. Pat. No. 4,491,513.

FIELD OF THE INVENTION

The present invention relates to an improved process for the beneficiation of oil-shale wherein the oil-shale is treated in two or three stages with an aqueous ammonium salt solution wherein the pH of the first stage is about 5 to 9 and the pH of the second and third stages is in the range of about 0.5 to 5 or about 9 to 12 with the proviso that the pH range of the second and third cannot be the same.

BACKGROUND OF THE INVENTION

Oil-shale, a sedimentary rock found in vast formations in several parts of the world, contains about 5 to about 60 wt. % organic material. About 10% of this organic material is extractable with organic solvents and is called bitumen. The remainder of the organic material is insoluble in organic and inorganic solvents and is a crosslinked macromolecular material called kerogen. The remainder of the oil-shale is inorganic and is composed of various minerals including clays. Much work has recently been done to develop efficient methods for acquiring useful liquids and gases from oil-shale as replacements for petroleum products. The inherent mineral matter in oil-shale represents significant debits in both the handling and processing of the resource. Typically, the organic material which can be converted to useful fuels and chemical feedstocks, preferably liquids, represents only about 10–25 wt. % of the oil-shale. Furthermore, during processing there is considerable increased abrasive wear on preparation and conversion plants owing to the nature of the mineral matter contained in oil-shale. Also, relatively large reactor sizes are required to accommodate the higher material throughputs necessitated by the large quantities of mineral matter. Most important, is the fact that large quantities of rock must be heated to relatively high temperatures in order to break-down the kerogen of the oil-shale to liquid and gaseous products. This results in a loss in energy efficiency because much of this heat is not recoverable as useful work. In processes which include a catalyst during processing, there is a significant potential that the mineral matter, inherently present in the oil-shale, will contribute to catalyst poisoning. Consequently, various processes have been developed over the years to beneficiate, or demineralize, oil-shale prior to further processing to concentrate the organic material and to alleviate the above-mentioned problems associated with oil-shale processing.

Although both physical and chemical methods have been developed for separating organic material from oil-shale thereby leaving substantially all of the mineral matter behind, chemical methods usually are superior over physical methods because of better separations obtained. One common type of chemical method for the separation of kerogen from oil-shale is acid dissolution of the inorganics. Such a technique typically involves the digestion of oil-shale with hydrochloric acid, hydrofluoric acid, or both. The hydrochloric acid dissolves the carbonate minerals and the hydrofluoric acid dissolves the silicate and clay minerals, thereby leaving a kerogen material containing about 5 to 10 wt. % mineral matter. Although such schemes have met with varying degrees of success, they suffer the disadvantage of being corrossive and, in most cases the inability to regenerate the acid reagents economically for recycle makes the process unattractive.

A variation in this acid technique is disclosed by R. D. Thomas in Fuel, 48, 75–80 (1969) wherein all of the mineral carbonates are removed from Green River oil-shale by treatment with carbonic acid. Thomas discloses that after sodium hydroxide washing to remove fine clay-like particles, the carbonate-free material can be centrifuged in a saturated aqueous calcium chloride solution to yield a concentrate containing 85–90 wt. % of the original kerogen with an ash content of less than 30 wt. %. Attempts to reproduce the physical separation results after demineralization with carbonic acid have been unsuccessful. See Vandergrift, G. F., Winans, R. E., and Horowitz, E. P., Fuel, 59, 634–6 (1980).

A variation of using acids to enrich the kerogen content of oil-shales which are rich in carbonates involves leaching by use of a sulfuric acid medium generated by the oxidizing capabilities of specific bacteria which convert pyrite in the oilshale to sulfuric acid. The sulfuric acid produced decomposes the carbonate minerals in the oil-shale leaving a kerogen enriched material containing significant amounts of silica. See U.S. Pat. No. 4,043,884.

Other approaches to chemical beneficiation include extraction of low grade Western U.S. oil-shales with aliphatic amides to recover 69 wt. % to 83 wt. % of the organics (U.S. Pat. No. 4,357,230), and treatment of various oil-shales with a 1:1 mixture of trichloroisocyanuric acid and a chlorine donor such as calcium hypochlorite in the presence of a petroleum based naphtha solvent giving recoveries of organics up to about 98 wt. % (U.K. Pat. No. 2,090,858).

Furthermore, disclosed in Intl. Patent Appl. Wo 82/03404 is a two-step treatment of oil-shale with 16 parts of fused alkali metal caustic at 350° C. for 40 minutes followed by a sulfuric acid wash which led to recovery of 86 wt. % of the organics. This type of treatment suffers from the disadvantage that it may have a detrimental effect on the kerogen structure and reactivity.

Although various methods have been used, including physical grinding combined with chemical treatment, for beneficiating oil-shale, such prior art methods have not been able to remove a significant amount of mineral matter from the organic material under relatively mild conditions without the reagent being simultaneously and irreversibly destroyed. Consequently, there is still a need in the art for processes which are able to beneficiate oil-shale under relatively mild conditions and leave the beneficiation reagent in a form which is easily regenerable. Furthermore, none of the prior art methods suggest the use of ammonium salts for beneficiating oil-shales.

SUMMARY OF THE INVENTION

In accordance with the present invention there is provided a method for beneficiating oil-shale which method comprises contacting the oil-shale in a first stage with an ammonium salt solution and in a second stage and optionally a third stage preferably in the presence of a solution containing ammonium ions/ammonia, or both. The first stage is conducted at a pH in the range of about 5 to 9 and the second and optional third stage is conducted at a pH in the range of about 0.5 to 5 or about 9 to 12 in the presence of an organic solvent with the proviso that the pH range of the second and third stage not be the same. The temperature at each stage is in the range of about 0° C. to about 300° C.

In preferred embodiments of the present invention an organic solvent is also present during the first stage.

In still other preferred embodiments of the present invention the ammonium salt is selected from the group consisting of ammonium carbonate, ammonium bicarbonate, ammonium acetate, ammonium chloride, ammonium nitrate, ammonium phosphates, and ammonium sulfate and the one or more stages are practiced at a temperature from about 60° C. to 100° at about atmospheric pressure.

In yet other preferred embodiments of the present invention a nonionic surfactant is present in any one or more of the stages.

DETAILED DESCRIPTION OF THE INVENTION

The general composition and characteristics of oil-shale are well known (See "Kerogen" edited by B. Durand, Editors Technip, Paris 1980) and will therefore not be described in detail herein. For practical purposes, the oil-shale should contain at least about 5, preferably at least about 10, and more preferably at least about 20% by weight of organic material, based on the total weight of the oil-shale. Such oil-shales usually contain at least about 7.5, preferably at least about 15, and more preferably between about 25 and 75 gallons of oil per ton of oil-shale, by Fischer Assay.

Although the present invention can be practiced on any type of oil-shale, it is more advantageous to employ an oil shale having high carbonate and clay mineral matter compositions.

Although the particle size of the oil-shale is not critical, it is preferred for convenience of handling that the oil-shale be crushed to a particle size having an average diameter of less than about 1 inch, preferably less than about ½ inch. The diameter of the particles as referred to herein is the smallest size of the screen opening through which particles of the designated "diameter" will pass.

Ammonium salts suitable for use in any one or more of the stages of the instant invention are ammonium salts of organic and inorganic acids. Preferred are the ammonium salts of strong mineral acids. Nonlimiting examples of such ammonium salts suitable for use herein include ammonium carbonate, ammonium bicarbonate, ammonium acetate, ammonium chloride, ammonium nitrate, ammonium sulfate, and ammonium phosphates. Preferred are ammonium nitrate and ammonium sulfate, more preferred is ammonium sulfate.

Preferably, the ammonium salt solution of the first stage is present in at least a stoichiometric amount based on the amount of carbonate minerals present in the oil-shale. Generally, a 1 to 4 molar solution of the ammonium salt is adequate.

Organic solvents which are used in any one or more of the stages herein, preferably stages two and three, are those which are immissible with water. Non-limiting examples include toluene, heptane, BTX streams, cyclohexane, petroleum and coal derived distillates, and boiling point fractions of oil-shale liquids. By BTX stream, we mean a stream comprised essentially of benzene, toluene, and xylene. Preferred is a middle to high boiling point shale-oil fraction, especially one which is a product of the instant invention. It is to be noted that when the oil-shale to be treated in accordance with the present invention is oil-shale from the Rundle deposits in Australia, at least a portion of the organic solvent must be a shale-oil.

In the practice of the present invention, the ratio (by volume) of organic solvent to aqueous solution will range from about 0.4:1 to 2:1, preferably from about 0.4:1 to 0.6:1.

The temperatures at which the stages of the instant process are carried out will generally be from about 0° C. to about 100° C., preferably about 60° C. to 100° C., when atmospheric pressure is employed. If higher pressures are employed, the temperature can be as high as about 300° C. If salts such as ammonium carbonate and ammonium bicarbonate are used, which decompose at temperatures greater than about 50° C., elevated pressures must be used to keep the components of the salts in solution and care must be taken to maintain a low partial pressure of $CO_2$ in order to facilitate the decomposition reaction of carbonate minerals.

In the practice of the present invention, oil-shale is contacted in a first stage with the aqueous ammonium salt solution for an effective amount of time in an appropriate reactor at a temperature from about 0° C. to 300° C. and in a pH range of about 5 to 9. Effective amount of time means for a time sufficient to remove a desired amount of carbonate minerals from the oil-shale. It will be appreciated that the specific amount of time and temperature will be dependent on such things as, the specific ammonium salt, the amount of ammonium salt, pressure, and size of the oil-shale employed. By way of example, a one molar aqueous solution of ammonium sulfate will remove at least about 80 wt.% of the carbonate mineral matter from 80–100 mesh particles of Green River oil-shale which contains about 20.6 wt.% organic material and about 40 wt.% carbonate minerals when the oil-shale is contacted with a 1M ammonium sulfate solution for 2 days at a temperature of 100° C.

After the predetermined amount of mineral matter has been removed from the oil-shale, the result is a two phase system. That is, there will be an upper aqueous phase and a lower solids phase. Carbon dioxide and ammonia gas, which evolve during the decomposition of minerals, can be recovered and used in the regeneration of the ammonium salt. The resulting solid phase, which is higher in organic content than the starting oil-shale, is passed to a second stage and treated with a solution containing ammonium ions, ammonia, or both, for an effective amount of time at an effective temperature in the presence of an organic solvent wherein the pH of the solution during this second stage is either from about 0.5 to 5 or about 9 to 12. The solids from the second stage may then be passed along to a third stage wherein the pH of the third stage will be 0.5 to 5 if the pH of the second stage was from about 9 to 12 or the pH of the third stage will be from about 9 to 12 if the pH of the second stage was from about 0.5 to 5.

During treatment in the first stage carbonate minerals of the oil-shale are essentially decomposed, leaving quartz and clay as the predominant mineral matter. If it is desired to preferentially remove quartz then the second stage is conducted at a pH in the range of about 0.5 to 5. If it is desired to preferentially remove the clay minerals, then the second stage is conducted at a pH in the range of about 9 to 12. Of course a third stage may be used to remove the mineral matter left from the second stage. For example, the third stage will be conducted at a pH in the range of about 0.5 to 5 if quartz remains, and a range of about 9 to 12 if clay remains. More acidic conditions are needed for the preferential removal of quartz because the surface of the quartz crystallites are negatively charged, therefore, treating the essentially carbonate free product of the first stage with a more acidic solution neutralizes the negative charge and facilitates agglomeration and precipitation of the quartz. The term, preferential removal is used because some clays will precipitate in the lower pH range and some quartz will be removed in the higher pH range. Feldspars, which are neutral, and typically larger crystals are equally likely to be removed at high or low pH ranges.

In the second and optional third stages, it is desirable to have an insoluble organic layer present to allow the precipitated minerals to remain separated from the kerogen. It is to be understood herein that anyone or more of the stages can consist of one or more cycles.

While not wishing to be bound by theory, we believe the staging of pH in the process of the present invention is advantageous because it permits us to increase selectivity to different reactions which in turn are more rapid over a given pH range and thereby increase the overall enrichment rate. For example, the decomposition of carbonate minerals is a stoichiometric reaction known to be more rapid under conditions of low pH. Therefore, to increase the carbonate decomposition rate, it is preferable to maintain the pH in the acid range (pH 5–6) instead of allowing the pH to drift to between 8 and 9. If this is done in a first stage, it produces a more porous rock and enables the small ammonia molecule and/or ammonium ion, in subsequent steps, to gain access to the clay-kerogen interaction sites and disrupt these either by displacement or by ion exchange. This effect can be achieved by using several cycles, in the first stage, of treatment with fresh ammonium sulfate solutions and/or by sparging an inert gas or gas mixture through the reaction mixture to remove the basic ammonia formed during the reaction. Furthermore, the rate of carbonate decomposition is more rapid in the absence of the insoluble organic layer, probably because contacting by the aqueous solution is better. Therefore, carrying out the first stage in the absence of the insoluble layer is also an option. By use of this approach, using four half-hour cycles with fresh ammonium sulfate solution, no insoluble organic layer and nitrogen sparging, over 90% of the carbonates can be removed from Green River oil shale in 2 hours at 90° C. instead of essentially the same amount in 72 hours at 85° C. in the presence of an organic solvent.

After treatment in any stage employing an organic solvent, the result is a three phase system. That is, there will be an upper solvent phase, a middle aqueous phase, and a lower solids phase. The upper solvent phase will contain organic rich material from the oil-shale, which organic material may be separated from the solvent by conventional distillation techniques or sent, either partially or in whole, directly to a conversion step. The middle aqueous phase contains dissolved mineral matter and excess ammonium ions/ammonia containing solution, and the lower solids phase is the mineral rich oil-shale fraction which has undergone at least two beneficiation stages.

Organic rich material which is not sent directly to conversion in the second stage is passed to a third stage wherein it is treated again with a solution preferably containing ammonium ions/ammonia, or both, in the presence of an organic solvent but this time in a pH range different than that of the second stage. That is, if the second stage was conducted in the pH range of 0.5 to 5 then the third stage is conducted in the pH range of 9 to 12, and vise versa.

It is also within the scope of the present invention to use a nonionic surfactant in any one or more of the stages. Anionic and cationic surfactants are not suitable for the practice of the present invention because they are not capable of achieving a physical separation of the organic rich material from the mineral matter after the oil-shale is treated with the ammonium salt solution. The amount of surfactant which can be used herein will be in excess of about 0.1 wt. %, based on the weight of the ammonium salt solution.

Non-limiting examples of such nonionic surfactants include ethoxylated derivatives of phenols, amines, carboxylic acids, alcohols and mercaptans, as well as polyhydroxy compoounds. The ethoxylated phenols may have the formula:

$$(R)_r A—[O(CH_2CH_2O)_p]_qH$$

wherein R is a $C_1$ to $C_{24}$ alkyl, A is benzene, naphthalene or diphenyl, p is 2 to 60, q is 1 or 2 and r is 1 to 5 with the proviso that when r is 1, R is at least $C_8$. Preferred nonionic surfactants are ethoxylated $C_8$–$C_{24}$ alkylphenols, ethoxylated octyl, nonyl or dodecyl phenols containing 8 to 24 —$CH_2CH_2O$-groups, or ethoxylated dimonyl phenols containing 8 to 50—$CH_2CH_2O$-groups.

Ethoxylated amines may be cationic or nonionic depending on the degree off ethoxylation. Higher degrees of ethoxylation render fatty amines nonionic in character. Preferred amines are $C_8$ to $C_{30}$ alkyl amines, $C_8$ to $C_{30}$ ethoxylated amines or quaternary ammonium salts thereof. Ethoxylated amines of the formula:

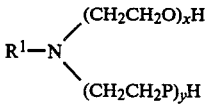

where $R^1$ is a $C_8$ to $C_{30}$ aliphatic radical and the sum of x+y is from 2 to 30.

Aliphatic carboxylic acids of from 8 to 30 carbon atoms can be esterified with ethylene oxide to form nonionic surfactants. The degree of ethyoxylation may be from 2 to 30. Also, $C_8$ to $C_{25}$ alkanols and mercaptans can be converted to polethoxy ethers and thio-ethers by reaction with ethylene oxide.

Examples of nonionic surfactants which are not polyethoxylated are esters of sugar alcohols, sorbitol and mannitol. The acid moiety of the ester is generally a fatty acid. Other fatty acid derivatives include esters of di-and poly saccharides and condensates of fatty acids with alkanolamines.

The following examples serve to more fully describe the manner of practicing the above-described invention as well as to set forth the best modes contemplated for carrying out various aspects of the invention. It is to be understood that these examples in no way serve to limit the true scope of this invention, but rather, are presented for illustrative purposes.

EXAMPLE 1

(Comparative)

A reaction mixture containing Green River oil-shale (4 g containing 21.8 wt. % organic material), 1.0 M aqueous ammonium sulfate solution (40 ml) and toluene (25 ml) was heated to and maintained with stirring at 85° C. under a nitrogen atmosphere for 72 hours. At the end of the 72 hour period, there was a dark brown top layer of oil shale organics dispersed in toluene, a substantially clear aqueous middle layer, and a white solids mineral matter bottom layer. The reaction mixture was allowed to cool to room temperature and the top organic layer was separated, filtered and washed with distilled water and methanol to wash away residual toluene from the oil shale organics. The solid layer was also filtered and washed with water and methanol. Both solid materials, from the toluene layer and the solids layer, which remained after filtering were dried for about 16 hours at 100° C.

Analysis of the solids from the toluene layer revealed an organic content of 62 wt. %, whereas the solids from the bottom layer contained 7 wt. % organic material. In this example a beneficiated oil shale material containing about three times as much organic material as the starting oil shale has been obtained.

EXAMPLE 2

(Comparative)

The above example was repeated except a 300 ml Autoclave Engineer's autoclave containing a glass liner was used. The reaction mixture was heated to and maintained at 175° C. for 1.5 hours. An opened 10 ml stainless steel bomb containing Ascarite II was attached to the reactor in order to absorb carbon dioxide formed by decomposition of carbonate minerals in the shale. This was done so that the carbon dioxide partial pressure would not build up and inhibit the forward decomposition reaction. At the end of the 1.5 hour reaction period the reaction mixture was cooled to room temperature and the glass liner containing the reaction products was removed. The work-up procedure followed in Example 1 above was repeated. In this example analysis of the solids from the toluene layer revealed an organic content of 40 wt. %, whereas the solids from the bottom mineral layer contained 4 wt. % organics.

EXAMPLE 3

The beneficiated product of Example 1 containing 62 wt. % organic material was treated in a second step with 2 M aqueous ammonium sulfate solution (50 ml) and toluene (20 ml). The reaction mixture was acidified to pH=1 by addition of aqueous sulfuric acid and then heated to and maintained at 85° C. for 48 hours. The reaction mixture was allowed to settle and the dark brown top layer of oil shale organics dispersed in toluene and the bottom solids layer were separated, filtered, washed and dried as described previously.

Analysis of the solids from the toluene layer revealed an organic content of 78 wt. % organic material. In this example, the previously beneficiated product containing 62 wt. % organics which had been generated over a pH range of 5.3 to 8.0 was treated at pH 1.0 to give a product containing only 22 wt. % mineral matter as compared to 78 wt. % mineral matter in the starting oil shale.

EXAMPLE 4

The beneficiated product of Example 2 containing 40 wt. % organic material was treated in a second step with 2 M aqueous ammonium sulfate solution (50 ml) and toluene (50 ml). The reaction mixture was acidified to pH=1 by the addition of aqueous sulfuric acid and then heated to and maintained at 85° C. for 24 hours. The reaction mixture was then worked-up as previously described.

Analysis of the solids from the toluene layer revealed an organic content of 55 wt. % whereas the solids from the bottom layer contained 11 wt. % organic material.

EXAMPLE 5

The beneficiated product of Example 2 containing 40 wt. % organic material was treated in a second step with sulfuric acid (0.4 N, 50 ml) and toluene (50 ml). Sulfuric acid was added to reach a pH of 1 and the reaction mixture was heated to and maintained at 85° C. for 70 hours. The reaction mixture was worked-up as previously described.

Analysis of the solids from the toluene layer revealed on organic content of 57 wt. % whereas the solids from the bottom layer contained 6 wt. % organic material.

EXAMPLE 6

To a 100 ml round bottom flask with a side arm and a cooling condenser was added Green River oil shale (10.00 g, 2.91 g $CO_3$ minerals, −80/100 mesh) and a magnetic stir bar. Ammonium sulfate (30 ml of 2.0 M solution, pH 5.3, 2 molar equivalents) was next charged into the vessel. A pipette was inserted through the side arm so that the tip was below the surface of the aqueous solution through which nitrogen was bubbled in at a rate of 50 cc/min.

While stirring, the reaction mixture was heated to and maintained at 90° C. for 30 minutes. Because of the angle of the cooling condenser (70°), the condensate was easily removed and collected as a clear liquid (~10 ml) having a pH greater than 11.

After the 30 minute reaction time, the heat was removed, the nitrogen tube taken out, and the stirring stopped. The entire mixture was poured into a 600 ml, Teflon filter, paper-lined Buchner funnel and filtered. The pale yellow filtrate was collected (pH 5.6). The remaining solids were washed with water (8×500 ml) and methanol (4×500 ml). After 2 hours of nitrogen blanketing/vacuum drying, the product was weighed (9.13 g). TGA analysis of the product indicated that the weight loss corresponded directly with the carbonate reduction 30.0 wt. % of total carbonate minerals removed).

The product was next treated, as above, with another 2 molar equivalents of fresh ammonium sulfate. The second cycle product weighed 8.57 g, showing a cumulative loss of 1.43 g which represents 49.1 wt. % of the total carbonates in the starting shale.

The product from the second cycle was treated, as above, a third and fourth time giving 70.1 and 90.3, respectively, wt. % losses of total carbonates. All condensates had a pH greater than 11 and each filtrate's pH remained between 5 and 6.

The total reaction time for the four cycles of stage 1 was 4×30 minutes.

EXAMPLE 7

A carbonate free Green River oil shale from Stage I was treated in the presence of an organic solvent at varying pH's as illustrated below:

SECOND STAGE ENRICHMENT OF CARBONATE FREE GREEN RIVER OIL SHALE[1] WITH ORGANIC SOLVENT PRESENT

| Time (Mins.) | Solvent (Organic) | Temp. (°C.) | Aqueous Layer, Initial pH | | Minerals Removed (Wt. %) | Final Kerogen (Wt. % Organics) |
|---|---|---|---|---|---|---|
| 30 | Toluene | 70 | $(NH_4)_2SO_4/NH_4OH$, | pH = 11.0 | 6.0 | 42.0 |
| 30 | Toluene | 70 | $NH_4OH$ (Dilute), | pH = 11.0 | 5.8 | 42.6 |
| 30 | Xylenes | 90 | $(NH_4)_2SO_4/NH_4OH$, | pH = 11.0 | 13.4 | 47.1 |
| 30 | Xylenes | 90 | $(NH_4)_2SO_4/NH_4OH$, | pH = 11.0 | 10.0 | 44.6 |
| 30 | Xylenes | 90 | $NH_4OH$ (Dilute), | pH = 11.0 | 13.0 | 45.5 |
| 10 | Xylenes | 90 | $(NH_4)_2SO_4/NH_4OH$, | pH = 11.0 | 8.0 | 44.3 |
| 30 × 2[2] | Xylenes | 90 | $NH_4OH$ (Dilute), | pH = 11.0 | 21.2 | 53.3 |

[1]37.2 wt. % organics
[2]Two 30 min. treatments.
Wt. % minerals removed represents a cumulative value.

These results evidence that a second stage treatment at pH 11 for only 30 minutes significantly enriches the amount of organics in the final kerogen fraction by separation of additional minerals. When the second stage consists of two cycles, as indicated in the last entry above, additional enrichment is obtained.

EXAMPLE 8

Two Stage Procedure for the Enrichment of Rundle, Ramsey Crossing Oil Shale Using Aqueous Ammonium Sulfate and Rundle Shale Oil/Xylenes

Stage 1

The procedure used for Example 1 was repeated on 5.08 g of Rundle, Ramsay Crossing oil shale, only the reaction time was increased from 21.5 to 70.0 hours. Using the same work up procedure resulted in the following recoveries: float fraction (dark brown)=3.65 g, sink fraction (light gray)=0.73 g.

Elemental analysis of the two fractions showed that the float fraction contained greater than 98 wt. % of the original organics. This is an increase in wt. % organics from 17.8 to 26.4. The sink fraction was found to contain greater than 97 wt. % ash.

Stage 2

The float fraction from stage 1, containing 26.4 wt. % organics, was separated into halves. Each half was treated as in stage 1 only no ammonium sulfate was used. One half was treated with dilute ammonium hydroxide (pH 11) while the other was treated with dilute sulfuric acid (pH 2.5). Both treatments were in the presence of the same Rundle shale oil/xylenes solution and their reaction times were only one hour each. The same work up procedure was used for both reactions.

The float fraction from the low pH treatment contained greater than 98 wt. % of the original organics and the final wt. % organic content was 33.0. This is 1.9 fold enrichment.

The float fraction from the high pH treatment contained greater than 97 wt. % of the original organics and the final wt. % organic content was 28.4.

What is claimed is

1. A process for beneficiating oil-shale which method comprises contacting the oil-shale in two stages wherein the stages are characterized as follows:

stage 1 is conducted at pH in the range of about 5 to 9 in the presence of an aqueous ammonium salt solution;

stage 2 being conducted at a pH in the range of about 0.5 to 5 or about 9 to 12 in the presence of an organic solvent at a temperature in the range of about 0° C. to about 300° C. for an effective amount of time.

2. The process of claim 1 wherein the temperature of any one or more of the stages is from about 0° C. to about 100° C.

3. The process of claim 1 wherein the ammonium salt solution of any one or more of the stages contains one or more salts selected from the group consisting of ammonium carbonate, ammonium bicarbonate, ammonium acetate, ammonium chloride, ammonium nitrate, ammonium sulfate, and ammonium phosphates.

4. The process of claim 3 wherein the ammonium salt solution of any one or more of the stages contains one or both of ammonium nitrate and ammonium sulfate.

5. The process of claim 1 wherein a third stage is conducted at a pH in the range of about 0.5 to 5 or about 9 to 12 in the presence of an organic solvent with the proviso that the pH of stage 2 and 3 not be in the same range.

6. The process of claim 5 wherein the organic solvent of steps 2, 3, or both is selected from the group consisting of toluene, heptane, BTX streams, cyclohexane, petroleum and coal derived fractions, and boiling point fractions of oil-shale liquids, or mixtures thereof.

7. The process of claim 6 wherein the solvent to aqueous solution ratio, by volume, is about 0.4:1 to 2:1.

8. The process of claim 7 wherein the solvent is a boiling point fraction of oil-shale liquids.

9. The process of claim 6 wherein the ammonium salt solution contains one or more salts selected from the group consisting of ammonium carbonate, ammonium bicarbonate, ammonium acetate, ammonium chloride, ammonium nitrate, ammonium sulfate, and ammonium phosphates.

10. The process of claim 9 wherein the ammonium salt solution contains one or both of ammonium nitrate and ammonium sulfate.

11. The process of claim 1 wherein a nonionic surfactant is present.

12. The process of claim 9 wherein a nonionic surfactant is present.

13. The process of claim 11 wherein the nonionic surfactant is an ethoxylated derivative of a compound selected from the group consisting of phenols, amines, carboxylic acids, alcohols, mercaptans, and polyhydroxides.

14. The process of claim 13 wherein the surfactant is an ethoxylated phenol having the formula:

$$(R)_rA—[O(CH_2CH_2O)_p]_qH$$

wherein R is a $C_1$ to $C_{24}$ alkyl group, A is benzene, naphthalene or diphenyl, p is 2 to 60, q is 1 or 2, and r is 1 to 5 with the proviso that when r is 1, R is at least a $C_8$ alkyl group.

15. The process of claim 13 wherein the surfactant is an ethoxylated amine represented by the formula:

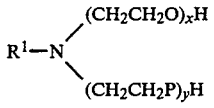

where $R^1$ is a $C_8$ to $C_{30}$ aliphatic radical and the sum of x+y is from 2 to 30.

16. The process of claim 1 wherein an organic solvent is present during the first stage.

17. The process of claim 8 wherein shale-oil is present during the first stage.

18. The process of claim 11 wherein an organic solvent is present during the first stage.

19. The process of claim 12 wherein an organic solvent is present during the first stage.

20. The process of claim 8 wherein the oil-shale is Rundle oil-shale.

21. The process of claim 1 wherein at least a portion of the organic solvent is a shale-oil and the oil-shale is Rundle oil-shale.

22. The process of claim 4 wherein at least a portion of the organic solvent is a shale-oil and the oil-shale is Rundle oil-shale.

23. The process of 22 wherein a nonionic surfactant is used in any one or more of the stages.

* * * * *